US011289293B2

(12) United States Patent
Luo et al.

(10) Patent No.: US 11,289,293 B2
(45) Date of Patent: Mar. 29, 2022

(54) CENTRIFUGAL SWITCH FOR A MOTOR OF A CLOTHES DRYER

(71) Applicants: Ningbo Zhenhai HongYe Electric Appliance & Meter CO., LTD, Ningbo (CN); CHANGZHOU HONEST ELECTRIC CO., LTD., Changzhou (CN)

(72) Inventors: Honghong Luo, Ningbo (CN); Jie Chen, Changzhou (CN)

(73) Assignees: Ningbo Zhenhai HongYe Electric Appliance & Meier CO., LTD, Ningbo (CN); CHANGZHOU HONEST ELECTRIC CO.. LTD., Changzhou (CN)

( * ) Notice: Subject to any disclaimer, the term of this patent is extended or adjusted under 35 U.S.C. 154(b) by 0 days.

(21) Appl. No.: 17/315,275

(22) Filed: May 8, 2021

(65) Prior Publication Data

US 2021/0391130 A1 Dec. 16, 2021

(30) Foreign Application Priority Data

Jun. 12, 2020 (CN) ..... 202021090754.8

(51) Int. Cl.

| | |
|---|---|
| ***H01H 35/10*** | (2006.01) |
| ***H01H 9/02*** | (2006.01) |
| ***D06F 58/34*** | (2020.01) |
| ***H01H 3/38*** | (2006.01) |
| ***H01H 1/14*** | (2006.01) |

(52) U.S. Cl.

CPC ..... *H01H 35/10* (2013.01); *D06F 58/34* (2020.02); *H01H 1/14* (2013.01); *H01H 3/38* (2013.01); *H01H 9/02* (2013.01)

(58) Field of Classification Search

CPC ..... H01H 35/10; H01H 1/14; H01H 3/38; H01H 9/02; D06F 58/34

USPC ..... 200/80 R, 532–535, 284, 275, 6 R, 60, 200/16 R, 553–559

See application file for complete search history.

(56) References Cited

U.S. PATENT DOCUMENTS 6,184,484 B1 * 2/2001 Wade, III ..... H01H 1/26 200/275
6,737,599 B1 * 5/2004 Lewis ..... H01H 3/60 200/275

FOREIGN PATENT DOCUMENTS

CN 106012427 A 10/2016

* cited by examiner

*Primary Examiner* — Edwin A. Leon
*Assistant Examiner* — Iman Malakooti
(74) *Attorney, Agent, or Firm* — Bayramoglu Law Offices LLC

(57) ABSTRACT

A centrifugal switch for a motor of a clothes dryer is provided. The end of a bracket and the end of a fixed contact piece are arranged in alignment and each has a raised contact. An upper limit piece slot is provided above the contact of the bracket inside the housing. The aligned ends of the bracket and the fixed contact piece are located above the aligned ends of a starting spring piece, a starting lower piece and a starting upper piece. A pressing head at one end of the rocking lever is located above one side of the fixed contact piece aligned with the bracket. The other end of the rocking lever extends outside the housing. When the centrifuge is not rotating, a movable sleeve of the centrifuge slides into the rocking lever to trigger the centrifugal switch.

20 Claims, 3 Drawing Sheets

CENTRIFUGAL SWITCH FOR A MOTOR OF A CLOTHES DRYER

CROSS REFERENCE TO THE RELATED APPLICATIONS

This application is based upon and claims priority to Chinese Patent Application No. 202021090754.8, filed on Jun. 12, 2020, the entire contents of which are incorporated herein by reference.

TECHNICAL FIELD

The present invention relates to a centrifugal switch, and more particularly, to a centrifugal switch for a motor of a clothes dryer.

BACKGROUND

A centrifugal switch is typically used to control the startup winding of a single-phase motor. In this case, the centrifugal switch is mounted to the rotor of the motor, and is electrically connected in series to a startup circuit. The switch is switched on when the rotor is stationary, and is switched off once the rotor approaches a certain rotational speed. In the prior art, there are some centrifugal switches used in clothes dryers or washing machines. For example, Chinese patent No. 201610546662.8, published on Oct. 12, 2016, discloses a power-off safety protection mechanism for a door lock switch of a washing machine. The patented mechanism includes a mounting housing and a door hook entrance arranged on the back of the mounting housing. A lock hook located at the inner end of the door hook entrance is provided in the mounting housing. Three parallel conductive sheets are provided on one side of the mounting housing. A power-off protection switch capable of being switched on and off is provided between the mounting housing and any one of the conductive sheets. A drive protection structure is further provided in the mounting housing and the drive protection structure is capable of driving the power-off protection switch to be switched on or off when the movable block extends into the door hook entrance or exits from the door hook entrance. This mechanism and other similar mechanisms are difficult to apply to the motor shaft of a clothes dryer because they cannot instantaneously achieve power-off protection, and they are inconvenient to manufacture and assemble.

SUMMARY

In order to overcome the above-mentioned shortcomings in the prior art, an objective of the present invention is to provide a centrifugal switch for a motor of a clothes dryer. The centrifugal switch solves the following technical problems: (1) current centrifugal switches cannot quickly open and close the contacts when used in the motor of a clothes dryer, which may cause serious damage to the motor; and (2) the internal components are poorly designed in structure and thus the arrangement of the contacts therein needs to be further improved. The objective of the present invention is achieved through the following technical solutions.

A centrifugal switch for a motor of a clothes dryer is provided. The outer side of the housing of the centrifugal switch is provided with a mounting hole. A fixed contact piece, a starting spring piece bracket, a starting spring piece, a starting lower piece, a starting upper piece and a bracket are fixedly buckled inside the housing. One end of the fixed contact piece, one end of the starting spring piece bracket, one end of the starting spring piece, one end of the starting lower piece, one end of the starting upper piece and one end of the bracket simultaneously extend outside a terminal on one side of the housing. The other end of the starting spring piece bracket inside the housing is fixedly connected to one end of the starting spring piece. The other end of the starting spring piece is aligned with the other end of the starting lower piece, and is provided with a raised contact. The other end of the starting upper piece is located above the contact of the starting spring piece, and is also provided with a raised contact. A rocking lever extending outside the housing is aligned with a movable sleeve of a centrifuge. The terminal of the housing is further provided with a retainer terminal lug. The retainer terminal lug is connected to a motor protector on the opposite side of a housing cover of the housing. The key point of the above structural design is that the other end of the bracket is aligned with the other end of the fixed contact piece. The other end of the bracket and the other end of the fixed contact piece are separately provided with a raised contact. An upper limit piece slot is provided above the contact of the bracket inside the housing. The aligned ends of the bracket and the fixed contact piece are located above the aligned ends of the starting spring piece, the starting lower piece and the starting upper piece. A rib partition column is provided between the aligned ends of the bracket and the fixed contact piece and the aligned ends of the starting spring piece, the starting lower piece and the starting upper piece. Both sides of the starting spring piece are separately provided with a raised contact. One side of the starting lower piece and one side of the starting upper piece are separately provided with a raised contact, wherein the contact of the starting lower piece is aligned with the contact of the starting upper piece. A lower limit piece slot is provided under the starting lower piece inside the housing. The portion of the rocking lever inside the housing is V-shaped. A pressing head at one end of the rocking lever is located above one side of the fixed contact piece aligned with the bracket. The end of the rocking lever is provided with an L-shaped end bent toward the fixed contact piece. The bend of the rocking lever is hinged to a rocking column of the housing. The other end of the rocking lever extends outside the housing. The fixed contact piece, the starting spring piece, the starting lower piece, the starting upper piece and the bracket are all L-shaped. The contacts are silver contacts. In this way, when the centrifuge is not rotating, the movable sleeve of the centrifuge slides into the rocking lever, and the centrifugal switch is triggered by the rocking lever.

The end of the fixed contact piece and the end of the bracket are separately provided with a double-contact parallel contact end, wherein the contact provided at the end of the fixed contact piece is aligned with the contact provided at the end of the bracket. Specifically, one end of a spring piece of the fixed contact piece is provided with symmetrically spaced double contacts, and correspondingly, one end of the bracket is also provided with symmetrically spaced double contacts. The end of the fixed contact piece aligned with the bracket is provided with the arched spring piece.

Similarly, the end of the starting spring piece, the end of the starting lower piece and the end of the starting upper piece are separately provided with a double-contact parallel contact end, wherein the contact provided at the end of the starting spring piece, the contact provided at the end of the starting lower piece and the contact provided at the end of the starting upper piece are aligned with each other. Specifically, one end of the starting spring piece is provided with symmetrically spaced double contacts, and correspondingly, one end of the starting lower piece and one end of the starting upper piece are separately provided with symmetrically spaced double contacts. In this way, a group of single-contact contacts in the centrifugal switch are replaced with double-contact parallel contacts, so that the centrifugal switch is safer and more stable.

A metal magnetic strip is arranged in a vertical gap between the double contacts of the bracket, and one end of the metal magnetic strip is fixed in the housing by a fixing screw.

The hinge joint between the rocking lever in the housing and the housing is provided with a protruding spring column extending into the housing. The spring column abuts against a spring in a spring groove, and the spring groove is arranged in the housing. Alternatively, a torsion spring is arranged at the hinge joint between the rocking lever and the housing. In this way, it is convenient to reset the rocking lever through the spring or the torsion spring.

A vertical rib is provided below the L-shaped end of the rocking lever. The fixed contact piece is located between the vertical rib and the L-shaped end. The vertical rib is integrated with the rocking lever through a side plate at the bottom of the housing. Through this arrangement, the linkage effect between the rocking lever and the fixed contact piece is further improved by means of clamping.

An external ground lug is arranged on the periphery of the housing cover to which one end of the fixed contact piece is fixed. One end of the external ground lug is provided with a through hole located in the mounting hole of the housing. The other end of the external ground lug is obliquely arranged at the terminal extending to a place between the fixed contact piece and the starting spring piece bracket. The external ground lug is configured to facilitate the mounting and assembly of the external ground lug.

The end of the starting spring piece, the end of the starting lower piece and the end of the starting upper piece are separately provided with a double-contact parallel contact end, wherein the contact provided at the end of the starting spring piece, the contact provided at the end of the starting lower piece and the contact provided at the end of the starting upper piece are aligned with each other. Specifically, one end of the starting spring piece is provided with symmetrically spaced double contacts, and correspondingly, one end of the starting lower piece and one end of the starting upper piece are separately provided with symmetrically spaced double contacts.

The present invention aims to solve the following technical problems: the existing centrifugal switch cannot quickly open and close the contacts when used in the motor of a clothes dryer and thus it is likely to cause serious damage to the motor; and the parts in the existing centrifugal switch are poorly designed and thus the arrangement of the contacts therein needs to be further improved. The key point of the present invention is as follows. One end of the bracket of the centrifugal switch is aligned with the other end of the fixed contact piece and is provided with a raised contact. Both sides of one end of the starting spring are separately provided with a raised contact. One side of the starting lower piece and one side of the starting upper piece are separately provided with a raised contact, wherein the contact of the starting lower piece is aligned with the contact of the starting upper piece. The end of the rocking lever is provided with an L-shaped end bent toward the fixed contact piece. The contacts are silver contacts. The end of the fixed contact piece and the end of the bracket are separately provided with a double-contact parallel contact end, wherein the contact provided at the end of the fixed contact piece is aligned with the contact provided at the end of the bracket. The end of the fixed contact piece aligned with the bracket is provided with an arched spring piece. A vertical rib is provided below the L-shaped end of the rocking lever. The fixed contact piece is located between the vertical rib and the L-shaped end. The vertical rib is integrated with the rocking lever through a side plate at the bottom of the housing. The centrifugal switch has a reasonable structural design, and thus is convenient to manufacture, assemble, use and mount, and further enhances stability and safety. The centrifugal switch of the present invention is suitable for a motor of a clothes dryer, and has an improved structure compared with the existing centrifugal switches.

Figure 1:
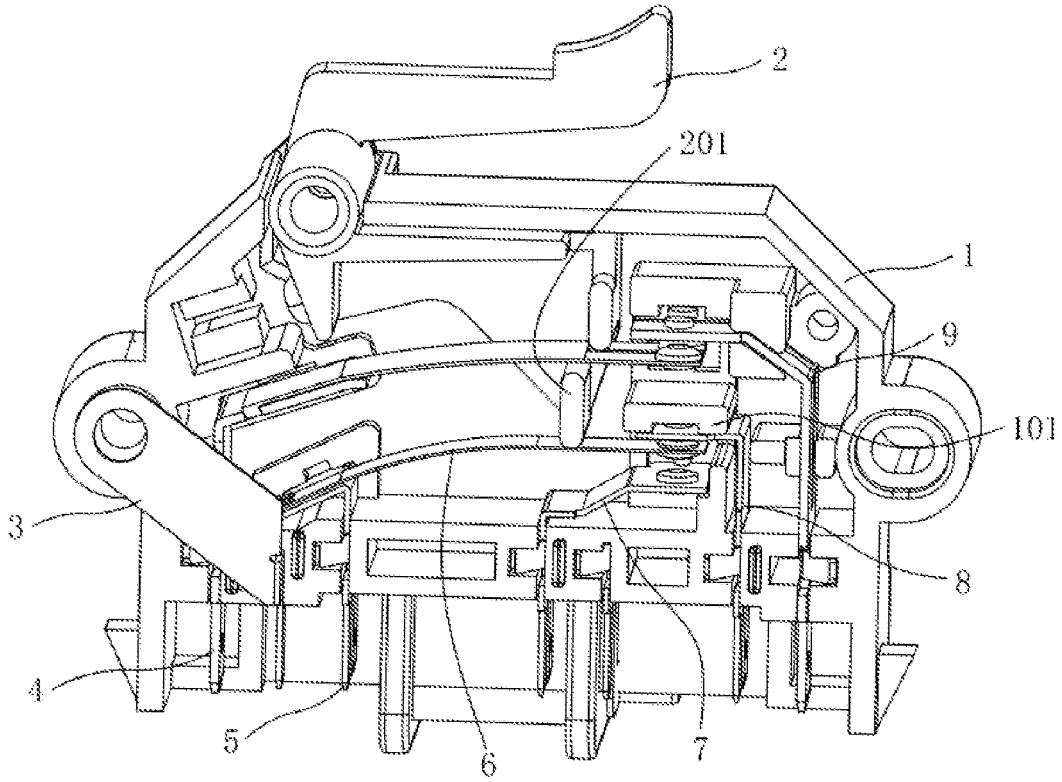
FIG. 1 is a schematic diagram of the internal structure of the present invention with the spring removed.
Figure 2:
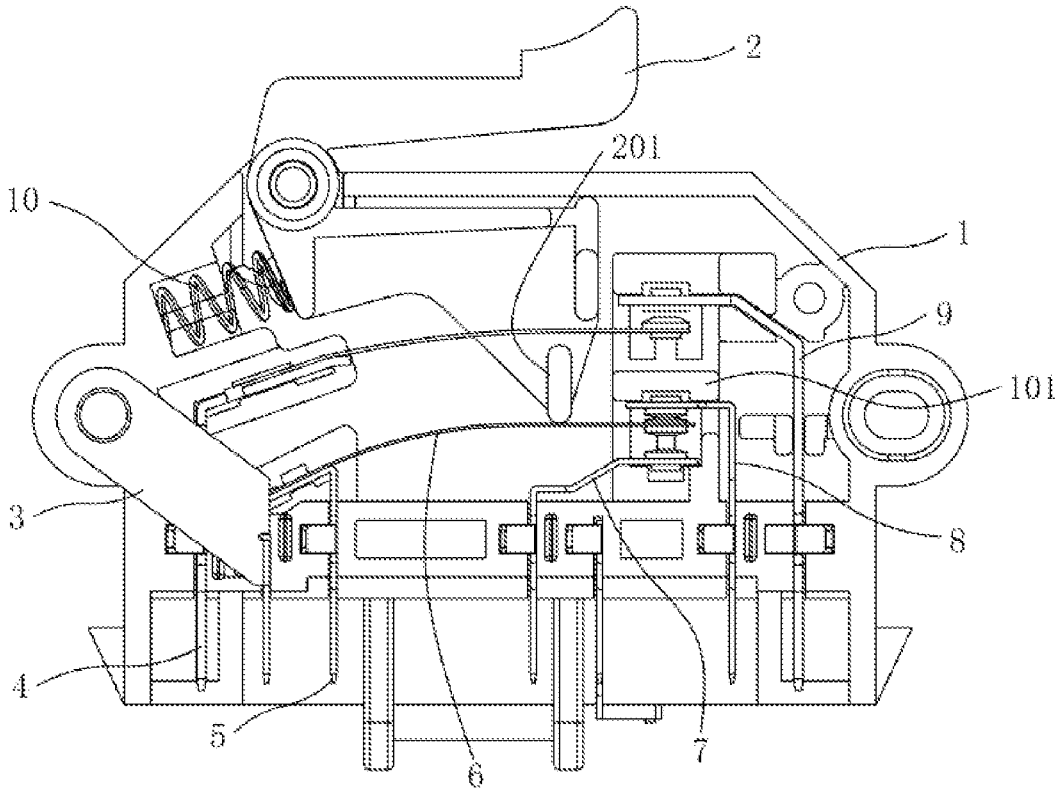
FIG. 2 is a front view of FIG. 1.
Figure 3:
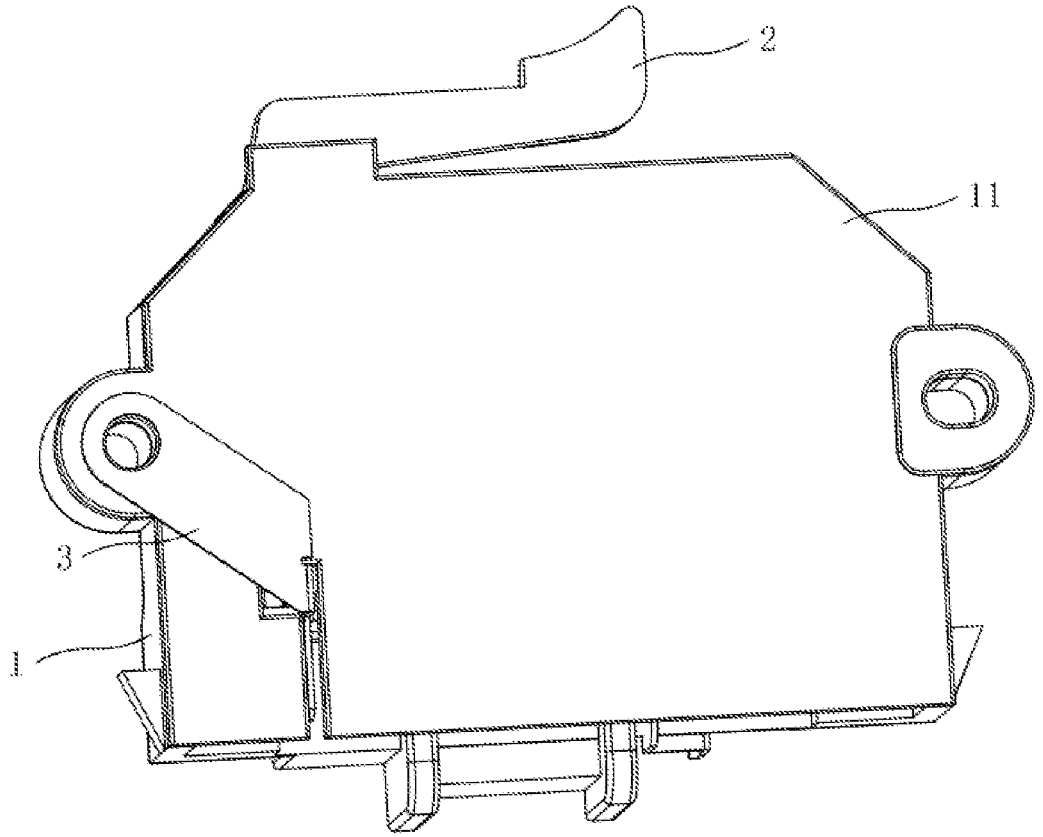
FIG. 3 is a schematic diagram of the external structure of FIG. 1.
Figure 4:
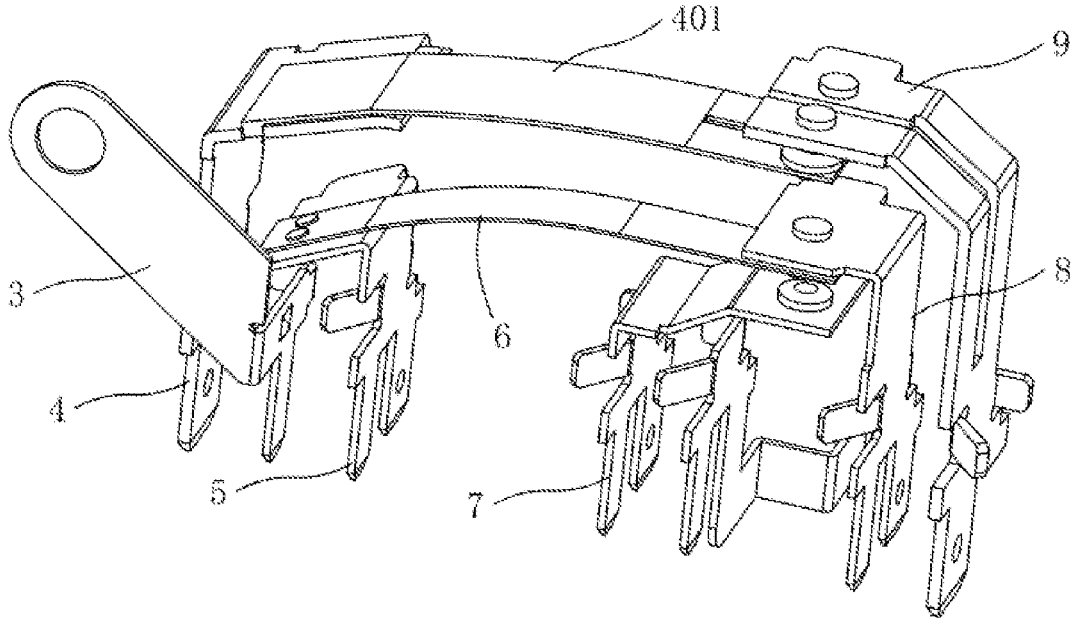
FIG. 4 is a schematic diagram of the internal structure of FIG. 1 with the housing and the rocking lever removed.

In the figures: 1, housing; 101, rib partition column; 2, rocking lever; 201, vertical rib; 3, external ground lug; 4, fixed contact piece; 401, spring piece; 5, starting spring piece bracket; 6, starting spring piece; 7, starting lower piece; 8, starting upper piece; 9, bracket; 10, spring; 11, housing cover; 12, metal magnetic strip; and 13, fixing screw.

DETAILED DESCRIPTION OF THE EMBODIMENTS

The structure and usability of the present invention will be further described below in combination with the drawings. As shown in FIGS. 1-4, the outer side of the housing 1 of the centrifugal switch is provided with a mounting hole. The fixed contact piece 4, the starting spring piece bracket 5, the starting spring piece 6, the starting lower piece 7, the starting upper piece 8 and the bracket 9 are fixedly buckled inside the housing. One end of the fixed contact piece, one end of the starting spring piece bracket, one end of the starting spring piece, one end of the starting lower piece, one end of the starting upper piece and one end of the bracket simultaneously extend outside a terminal on one side of the housing. The other end of the starting spring piece bracket inside the housing is fixedly connected to one end of the starting spring piece. The other end of the starting spring piece is aligned with the other end of the starting lower piece, and is provided with a raised contact. The other end of the starting upper piece is located above the contact of the starting spring piece, and is also provided with a raised contact. A rocking lever extending outside the housing is aligned with a movable sleeve of the centrifuge. The terminal of the housing is further provided with a retainer terminal lug. The retainer terminal lug is connected to a motor protector on the opposite side of a housing cover of the housing. The structure of the centrifugal switch is specifically described as follows. The other end of the bracket is aligned with the other end of the fixed contact piece. The other end of the bracket and the other end of the fixed contact piece are separately provided with a raised contact. An upper limit piece slot is provided above the contact of the bracket inside the housing. The aligned ends of the bracket and the fixed contact piece are located above the aligned ends of the starting spring piece, the starting lower piece and the starting upper piece. The rib partition column 101 is provided between the aligned ends of the bracket and the fixed contact piece and the aligned ends of the starting spring piece, the starting lower piece and the starting upper piece. Both sides of the starting spring piece are separately provided with a raised contact. One side of the starting lower piece and one side of the starting upper piece are separately provided with a raised contact, wherein the contact of the starting lower piece is aligned with the contact of the starting upper piece. A lower limit piece slot is provided under the starting lower piece inside the housing. The portion of the rocking lever 2 inside the housing is V-shaped. A pressing head at one end of the rocking lever is located above one side of the fixed contact piece aligned with the bracket. The end of the rocking lever is provided with an L-shaped end bent toward the fixed contact piece. The bend of the rocking lever is hinged to a rocking column of the housing. The other end of the rocking lever extends outside the housing. In addition, the vertical rib 201 is provided below the L-shaped end of the rocking lever. The fixed contact piece is located between the vertical rib and the L-shaped end. The vertical rib is integrated with the rocking lever through a side plate at the bottom of the housing.

The fixed contact piece, the starting spring piece, the starting lower piece, the starting upper piece and the bracket are all L-shaped. The contacts are silver contacts. The hinge joint between the rocking lever in the housing and the housing is provided with a protruding spring column extending into the housing. The spring column abuts against the spring 10 in a spring groove, and the spring groove is arranged in the housing. In addition, the end of the fixed contact piece and the end of the bracket are separately provided with a double-contact parallel contact end, wherein the contact provided at the end of the fixed contact piece is aligned with the contact provided at the end of the bracket. Specifically, one end of the spring piece 401 of the fixed contact piece is provided with symmetrically spaced double contacts, and correspondingly, one end of the bracket is also provided with symmetrically spaced double contacts. The end of the fixed contact piece aligned with the bracket is provided with the arched spring piece. The external ground lug 3 is arranged on the periphery of the housing cover to which one end of the fixed contact piece is fixed. One end of the external ground lug is provided with a through hole located in the mounting hole of the housing. The other end of the external ground lug is obliquely arranged at the terminal extending to a place between the fixed contact piece and the starting spring piece bracket. Similarly, the end of the starting spring piece 6, the end of the starting lower piece 7 and the end of the starting upper piece 8 are separately provided with a double-contact parallel contact end, wherein the contact provided at the end of the starting spring piece 6, the contact provided at the end of the starting lower piece 7 and the contact provided at the end of the starting upper piece 8 are aligned with each other. Specifically, one end of the starting spring piece 6 is provided with symmetrically spaced double contacts, and correspondingly, one end of the starting lower piece 7 and one end of the starting upper piece 8 are separately provided with symmetrically spaced double contacts.

Figure 5:
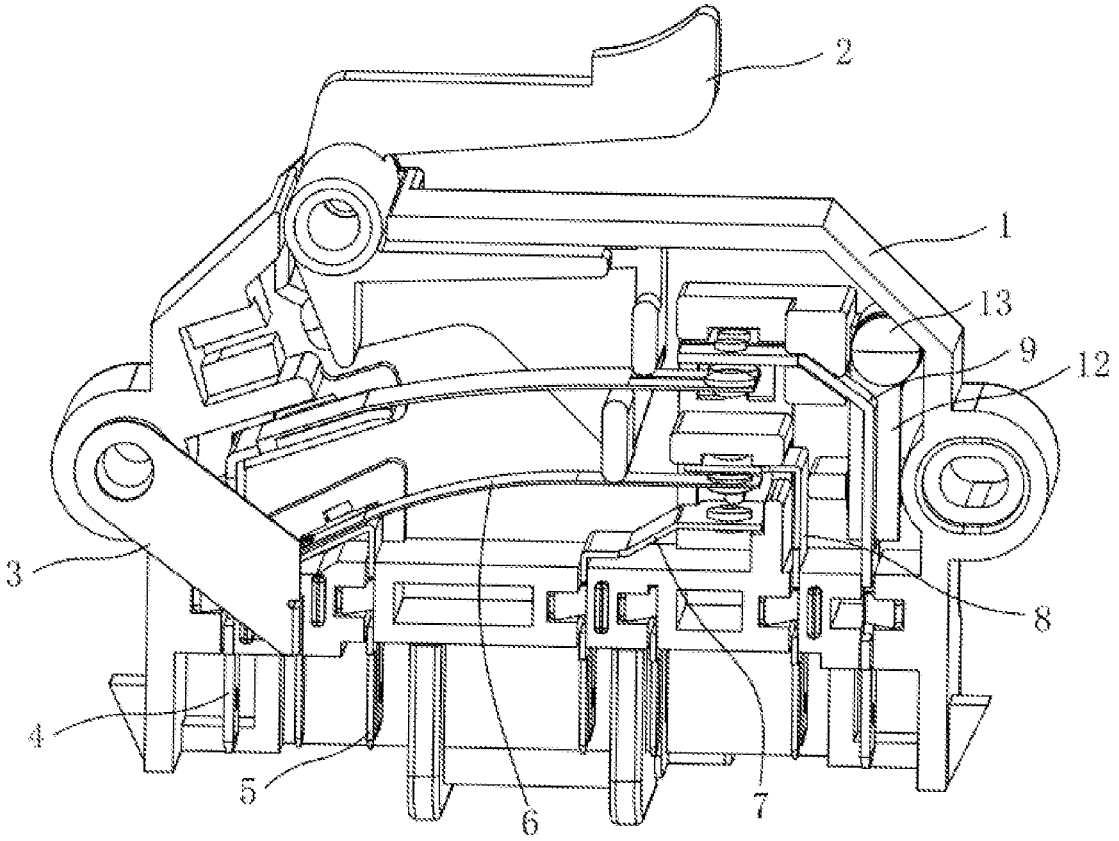
FIG. 5 is a schematic diagram of an improved structure of FIG. 1.

The centrifugal switch is mounted under a rotor shaft of the centrifuge. When the centrifuge is not rotating, the rotor shaft of the centrifuge slides into the rocking lever, and the centrifugal switch is triggered by the rocking lever. When the centrifuge rotates, the rotor shaft of the centrifuge is separated from the rocking lever, and the centrifugal switch is not triggered. Based on the above structural features, as shown in FIG. 5, the metal magnetic strip 12 is arranged in a vertical gap between the double contacts of the bracket, and one end of the metal magnetic strip is fixed in the housing by the fixing screw 13. In this way, the centrifugal switch can also achieve the same technical objective and technical effect.

What is claimed is:

1. A centrifugal switch for a motor of a clothes dryer, wherein an outer side of a housing of the centrifugal switch is provided with a mounting hole;

a fixed contact piece, a starting spring piece bracket, a starting spring piece, a starting lower piece, a starting upper piece and a bracket are fixedly buckled inside the housing;

a first end of the fixed contact piece, a first end of the starting spring piece bracket, a first end of the starting spring piece, a first end of the starting lower piece, a first end of the starting upper piece and a first end of the bracket simultaneously extend outside a terminal on one side of the housing;

a second end of the starting spring piece bracket inside the housing is fixedly connected to the first end of the starting spring piece;

a second end of the starting spring piece is aligned with a second end of the starting lower piece, and the second end of the starting spring piece is provided with a first raised contact;

a second end of the starting upper piece is located above the first raised contact, and the second end of the starting upper piece is provided with a second raised contact;

a rocking lever extending outside the housing is aligned with a movable sleeve of a centrifuge;

the terminal of the housing is further provided with a retainer terminal lug;

the retainer terminal lug is connected to a motor protector on an opposite side of a housing cover of the housing;

a second end of the bracket is aligned with a second end of the fixed contact piece;

the second end of the bracket is provided with a third raised contact, and the second end of the fixed contact piece is provided with a fourth raised contact;

an upper limit piece slot is provided above the third raised contact inside the housing;

the second ends of the bracket and the fixed contact piece are located above the second ends of the starting spring piece, the starting lower piece and the starting upper piece;

a rib partition column is provided between the second ends of the bracket and the fixed contact piece and the second ends of the starting spring piece, the starting lower piece and the starting upper piece;

both sides of the starting spring piece are separately provided with the first raised contact;

one side of the starting lower piece is provided with a fifth raised contact, and one side of the starting upper piece is provided with the second raised contact, wherein the fifth raised contact is aligned with the second raised contact;

a lower limit piece slot is provided under the starting lower piece inside the housing;

a portion of the rocking lever inside the housing is V-shaped;

a pressing head at a first end of the rocking lever is located above one side of the fixed contact piece aligned with the bracket;

a second end of the rocking lever is provided with an L-shaped end bent toward the fixed contact piece;

a bend of the rocking lever is hinged to a rocking column of the housing;

the second end of the rocking lever extends outside the housing;

the fixed contact piece, the starting spring piece, the starting lower piece, the starting upper piece and the bracket are all L-shaped; and the first raised contact, the raised second contact, the raised third contact, the raised fourth contact, and the raised fifth contact are silver contacts.

2. The centrifugal switch according to claim 1, wherein the second end of the fixed contact piece and the second end of the bracket are provided with a first double-contact parallel contact end and a second double-contact parallel contact end, respectively, wherein the fourth raised contact provided at the second end of the fixed contact piece is aligned with the third raised contact provided at the second end of the bracket; wherein one end of an arched spring piece of the fixed contact piece is provided with first symmetrically spaced double contacts, and the second end of the bracket is correspondingly provided with second symmetrically spaced double contacts; and the second end of the fixed contact piece aligned with the bracket is provided with the arched spring piece.

3. The centrifugal switch according to claim 1, wherein the second end of the starting spring piece, the second end of the starting lower piece and the second end of the starting upper piece are provided with a third double-contact parallel contact end, a fourth double-contact parallel contact end, and a fifth double-contact parallel contact end, respectively, wherein the first raised contact provided at the second end of the starting spring piece, the fifth raised contact provided at the second end of the starting lower piece and the second raised contact provided at the second end of the starting upper piece are aligned with each other; wherein the second end of the starting spring piece is provided with third symmetrically spaced double contacts, and the second end of the starting lower piece and the second end of the starting upper piece are correspondingly provided with fourth symmetrically spaced double contacts and fifth symmetrically spaced double contacts, respectively.

4. The centrifugal switch according to claim 2, wherein the second end of the starting spring piece, the second end of the starting lower piece and the second end of the starting upper piece are provided with a third double-contact parallel contact end, a fourth double-contact parallel contact end, and a fifth double-contact parallel contact end, respectively, wherein the first raised contact provided at the second end of the starting spring piece, the fifth raised contact provided at the second end of the starting lower piece and the second raised contact provided at the second end of the starting upper piece are aligned with each other; wherein the second end of the starting spring piece is provided with third symmetrically spaced double contacts, and the second end of the starting lower piece and the second end of the starting upper piece are correspondingly provided with fourth symmetrically spaced double contacts and fifth symmetrically spaced double contacts, respectively.

5. The centrifugal switch according to claim 1, wherein a metal magnetic strip is arranged in a vertical gap between second symmetrically spaced double contacts of the bracket, and one end of the metal magnetic strip is fixed in the housing by a fixing screw.

6. The centrifugal switch according to claim 5, wherein a hinge joint between the rocking lever in the housing and the housing is provided with a protruding spring column extending into the housing; the protruding spring column abuts against a spring in a spring groove, and the spring groove is arranged in the housing; or a torsion spring is arranged at the hinge joint between the rocking lever and the housing.

7. The centrifugal switch according to claim 6, wherein a vertical rib is provided below the L-shaped end of the rocking lever;

the fixed contact piece is located between the vertical rib and the L-shaped end; and the vertical rib is integrated with the rocking lever through a side plate at a bottom of the housing.

8. The centrifugal switch according to claim 7, wherein an external ground lug is arranged on a periphery of the housing cover, and the first end of the fixed contact piece is fixed to the housing cover;

a first end of the external ground lug is provided with a through hole located in the mounting hole of the housing; and a second end of the external ground lug is obliquely arranged at the terminal extending to a place between the fixed contact piece and the starting spring piece bracket.

9. The centrifugal switch according to claim 2, wherein a metal magnetic strip is arranged in a vertical gap between the second symmetrically spaced double contacts of the bracket, and one end of the metal magnetic strip is fixed in the housing by a fixing screw.

10. The centrifugal switch according to claim 3, wherein a metal magnetic strip is arranged in a vertical gap between second symmetrically spaced double contacts of the bracket, and one end of the metal magnetic strip is fixed in the housing by a fixing screw.

11. The centrifugal switch according to claim 4, wherein a metal magnetic strip is arranged in a vertical gap between the second symmetrically spaced double contacts of the bracket, and one end of the metal magnetic strip is fixed in the housing by a fixing screw.

12. The centrifugal switch according to claim 9, wherein a hinge joint between the rocking lever in the housing and the housing is provided with a protruding spring column extending into the housing; the protruding spring column abuts against a spring in a spring groove, and the spring groove is arranged in the housing; or a torsion spring is arranged at the hinge joint between the rocking lever and the housing.

13. The centrifugal switch according to claim 10, wherein a hinge joint between the rocking lever in the housing and the housing is provided with a protruding spring column extending into the housing; the protruding spring column abuts against a spring in a spring groove, and the spring groove is arranged in the housing; or a torsion spring is arranged at the hinge joint between the rocking lever and the housing.

14. The centrifugal switch according to claim 11, wherein a hinge joint between the rocking lever in the housing and the housing is provided with a protruding spring column extending into the housing; the protruding spring column abuts against a spring in a spring groove, and the spring groove is arranged in the housing; or a torsion spring is arranged at the hinge joint between the rocking lever and the housing.

15. The centrifugal switch according to claim 12, wherein a vertical rib is provided below the L-shaped end of the rocking lever;

the fixed contact piece is located between the vertical rib and the L-shaped end; and the vertical rib is integrated with the rocking lever through a side plate at a bottom of the housing.

16. The centrifugal switch according to claim 13, wherein a vertical rib is provided below the L-shaped end of the rocking lever;

the fixed contact piece is located between the vertical rib and the L-shaped end; and the vertical rib is integrated with the rocking lever through a side plate at a bottom of the housing.

17. The centrifugal switch according to claim 14, wherein a vertical rib is provided below the L-shaped end of the rocking lever;

the fixed contact piece is located between the vertical rib and the L-shaped end; and the vertical rib is integrated with the rocking lever through a side plate at a bottom of the housing.

18. The centrifugal switch according to claim 15, wherein an external ground lug is arranged on a periphery of the housing cover, and the first end of the fixed contact piece is fixed to the housing cover;

a first end of the external ground lug is provided with a through hole located in the mounting hole of the housing; and a second end of the external ground lug is obliquely arranged at the terminal extending to a place between the fixed contact piece and the starting spring piece bracket.

19. The centrifugal switch according to claim 16, wherein an external ground lug is arranged on a periphery of the housing cover, and the first end of the fixed contact piece is fixed to the housing cover;

a first end of the external ground lug is provided with a through hole located in the mounting hole of the housing; and a second end of the external ground lug is obliquely arranged at the terminal extending to a place between the fixed contact piece and the starting spring piece bracket.

20. The centrifugal switch according to claim 17, wherein an external ground lug is arranged on a periphery of the housing cover, and the first end of the fixed contact piece is fixed to the housing cover;

a first end of the external ground lug is provided with a through hole located in the mounting hole of the housing; and a second end of the external ground lug is obliquely arranged at the terminal extending to a place between the fixed contact piece and the starting spring piece bracket.

* * * * *